US007396803B2

(12) United States Patent
Bingeman

(10) Patent No.: US 7,396,803 B2
(45) Date of Patent: Jul. 8, 2008

(54) LOW FOAMING, LUBRICATING, WATER BASED EMULSIONS

(75) Inventor: Ronald E. Bingeman, Brook Haven, PA (US)

(73) Assignee: Croda Uniqema, Inc., Chicago, IL (US)

( * ) Notice: Subject to any disclaimer, the term of this patent is extended or adjusted under 35 U.S.C. 154(b) by 412 days.

(21) Appl. No.: 10/830,429

(22) Filed: Apr. 23, 2004

(65) Prior Publication Data

US 2005/0037933 A1 Feb. 17, 2005

Related U.S. Application Data

(60) Provisional application No. 60/465,137, filed on Apr. 24, 2003.

(51) Int. Cl.
*C10M 159/00* (2006.01)
*C10M 129/72* (2006.01)
*C10M 133/08* (2006.01)

(52) U.S. Cl. ..... 508/506; 508/545

(58) Field of Classification Search ..... 508/496, 508/545, 506
See application file for complete search history.

(56) References Cited

U.S. PATENT DOCUMENTS 3,813,337 A * 5/1974 Sheldahl et al. ..... 508/398
3,923,671 A * 12/1975 Knepp ..... 508/495
4,212,750 A * 7/1980 Gorman ..... 508/279
4,767,554 A * 8/1988 Malito et al. ..... 508/162
5,688,750 A 11/1997 Cooban et al. ..... 508/497
5,707,945 A * 1/1998 Cooban et al. ..... 508/497
6,060,438 A * 5/2000 Oleksiak ..... 508/485

FOREIGN PATENT DOCUMENTS

DE 2426925 12/1974

OTHER PUBLICATIONS

"Priolube™ 3955" product information, Uniqema (2002).
"Priolube™ 3952" product information, Uniqema (2003).
"Priolube™ 3951" product information, Uniqema (2003).
"Priolube™ 3953" product information, Uniqema (2003).

* cited by examiner

*Primary Examiner*—Glenn Caldarola
*Assistant Examiner*—Jim Goloboy
(74) *Attorney, Agent, or Firm*—Jones Day

(57) ABSTRACT

Mixtures of water immiscible components and water dispersible components, in combination with an optional coemulsifier and an optional coupling agent, provide synthetic (water based) emulsions that have enhanced lubricity, provide excellent cooling characteristics, are low foaming and biostable and can be made effectively transparent.

31 Claims, No Drawings

LOW FOAMING, LUBRICATING, WATER BASED EMULSIONS

CROSS REFERENCE TO RELATED APPLICATION

This application claims the benefit of U.S. Provisional Ser. No. 60/465,137, filed Apr. 24, 2003. This application, in its entirety, is incorporated herein by reference.

TECHNICAL FIELD

The present invention relates to emulsions for use in water extendable metal working fluids and in water extendable hydraulic fluids. More particularly, the present invention relates to stable synthetic low foaming emulsions comprising mixtures of water immiscible and water dispersible emulsifiers.

BACKGROUND OF THE INVENTION

The invention is useful in water based hydraulic fluids and in water based metal working fluids.

Examples of hydraulic fluids are those fluids used in hydraulic machinery such as brake mechanisms, shock absorbers, control mechanisms and the like. The main classes of hydraulic fluids commonly used are petroleum-based, water/glycol solutions, water-in-oil emulsions, and oil-in-water emulsions.

There are several notable disadvantages to conventional hydraulic fluids. The petroleum-based hydraulic fluids pose certain environmental and health risks. In addition, petroleum oils may be flammable. Further, petroleum is a non-renewable and limited natural resource and, if allowed to escape into the ground, can cause soil and groundwater contamination and associated health and environmental problems.

Water based hydraulic fluids are used in machinery that is not exposed to freezing, or near-freezing, temperatures, such as machinery that is used in underground mining operations or near blast furnaces. Such fluids can contain numerous components so emulsifiers are used to obtain both the required formulation and stability. Existing water based hydraulic fluids, however, often lack the stability or lubricity required to operate at high temperatures and pressures.

Thus, there is a need for water based hydraulic fluids which have the characteristics of desirable shear stability, rheology control, lubricity, stability, volatility, very little swelling effect on (synthetic) rubber and anti-wear properties while reducing potential harm to the environment. Such a variety of desirable characteristics, which sometimes conflict, is difficult to achieve in a single composition.

In America whereas some metal working is still carried out with the aid of oil-based metal working fluids, the preponderance is done with water extendable fluids. Such fluids can contain numerous components (e.g., base oil, water, emulsifier, corrosion inhibitor, biocide) and emulsifiers are used to obtain both the required formulation and emulsion stability. There are three major types of water extendable metal working fluids: (1) "soluble oil" systems, which comprise a base oil, such as mineral oil, synthetic oil (polyolefins), synthetic esters and vegetable oil derivatives, with an emulsifying agent which disperses readily in water to form milky oil-in-water emulsions (e.g., about 85 weight percent of the base oil and about 15 weight percent emulsifier); (2) "synthetic" systems, which are aqueous dispersions comprising water and additives such as lubricating agents, corrosion inhibitors and the like and are substantially free of base oil; and (3) "semi-synthetic" systems, which are typically emulsions comprising aqueous solutions of emulsifying agents containing lesser amounts of highly dispersed base oil (e.g., about 5 to about 30 weight percent base oil). These metal working fluids are often supplied as concentrates which are then diluted with water, usually to form a 2 to 10% concentration, before being charged to the machines.

The selection of an effective metal working fluid for a specific application requires careful consideration of several properties. Whereas good lubrication and effective cooling are important, additional properties such as biostability, low foaming (maximizing contact with the tool and workpiece surfaces), emulsion clarity (allowing visualization of the workpiece), waste treatment and toxicity are often important factors in a given application.

Indeed, some of the most desirable properties are antithetical. In synthetic metal working fluids, for example, coarse-grained (larger) synthetic emulsions enhance lubricity but also form opaque emulsions, which decrease clarity. Reducing the emulsion particle size to improve the ability to see the workpiece is normally accompanied by reduced lubricity and undesirable foaming. It is believed that the foaming is caused by the formation of soaps resulting from the breakdown of the lubricant under high stress (poor lubricity) conditions. The foaming problem also can be exacerbated with the inclusion of certain commonly used corrosion inhibitors and other additives, for example antiwear additives.

Further, metal working fluids are susceptible to microbial attack by, for example, bacteria, fungi, and yeasts, causing one or more symptoms such as odor development, a decrease in pH, a decrease in dissolved oxygen concentration, changes in emulsion stability, increased incidence of dermatitis, workpiece surface-blemishes, clogged filters and lines, increased workpiece rejection rates, decreased tool life and generally unpredictable changes in coolant chemistry. Because biofouling is a major expense to some mills and metal working shops, biocides are sometimes added to metal working fluids to enhance stability and extend bath-life. However, biocides have a limited lifetime and present issues of regarding worker safety, so it is desirable to use a metal working fluid composition that is biostable without the need for biocides. Unfortunately, all metal working fluids must be discarded eventually, and the preferred method of waste treatment is through biodegradation. Traditionally, biostable compositions often complicate disposal and suffer a disadvantage from this perspective.

Esterified trimer acids ("ETAs") are known to be useful in specific metal treatment fluid systems. They provide certain desirable properties, such as biostability, and can be disposed of using standard techniques. ETAs are derivatives of trimer acids, which, depending on the specific derivative, can be water immiscible or water dispersible. Water dispersible ETAs, for example, are useful in synthetic systems, whereas water immiscible ETAs (oil soluble) are ineffective in synthetic systems but useful in soluble oil systems.

Water immiscible ETAs are fully or nearly fully esterified with alkyl alcohols whereas water dispersible ETAs are partially esterified with alkylalkoxy alcohols only or in combination with alkyl alcohols but retain sufficient residual carboxylic acid groups which, when neutralized, render the derivatives water dispersible.

The different types of ETAs are used individually in different formulations depending on the type of emulsion desired. For example, U.S. Pat. No. 6,060,438 discloses the use of water immiscible ETAs, such as Priolube® 3953 (available from Uniqema, Del.) for use in semi-synthetic oil-in-water emulsions. The description of these water immiscible esters from the '438 patent is incorporated herein by reference. While such semi-synthetic systems are reported as having improved lubricity, biostability and reduced tendency to form soaps, they are opaque and cannot be used in applications where it is necessary or desirable to see the workpiece through the metal treatment fluid.

By contrast, U.S. Pat. Nos. 5,707,945 and 5,688,750 disclose the use of water dispersible ETAs, such as Priolube® 3951, Priolube® 3952 and Priolube® 3955 (available from Uniqema, Del.). The descriptions of water dispersible esters found in the '945 and '750 patents are incorporated herein by reference. Water extendable metal treatment fluids based on Priolube® 3951 emulsions are transparent and exhibit good boundary lubricity but experience high degrees of foaming. Water extendable metal treatment fluids based on Priolube® 3952 exhibit good boundary lubricity but are milky. Water extendable metal treatment fluids based on Priolube® 3955 exhibit good lubricity and are moderate foaming and translucent, turning to opaque.

Unfortunately, even with the advancements provided by the ETA technology, it has not been possible to provide a synthetic (water based) emulsion system that exhibits good lubricity, transparency, low foaming, and is both biostable and waste treatable. Thus, the selection of an appropriate water extendable metal working fluid for a given application required a decision as to which desirable property should be sacrificed at the expense of others. For this reason, synthetic metal working fluids are typically used in applications where cooling is the primary criterion, whereas the semi-synthetic and oil soluble fluids are used in applications where lubricity is more important.

Accordingly, there remains a need in the art for synthetic (water based) emulsion systems that exhibit good lubricity, transparency, low foaming, and that are both biostable and waste treatable.

SUMMARY OF THE INVENTION

Although water immiscible ETAs are known to be ineffective in synthetic water based fluids as they are not capable of dispersing in water, it was surprisingly found that when water immiscible and water dispersible emulsifiers are combined, the resulting emulsions or microemulsions exhibit enhanced lubricity, provide excellent cooling characteristics, are low foaming, biostable and can be made effectively transparent.

More particularly, the present invention relates to emulsions and emulsion systems that comprise: (A) a water immiscible component selected from the group consisting of polyhydroxystearic acid, polyhydroxyoleic acid, substantially fully esterified $C_1$ to $C_9$ alkyl esters of a trimer acid, and mixtures thereof; (B) at least one water dispersible ETA as an emulsifier; (C) an optional co-emulsifier which is a $C_8$ to $C_{20}$ fatty acid; and (D) optionally an alkoxylate coupling agent, wherein, to the extent that components (B) or (C) are not in a salt form, a neutralizing agent is present in an amount sufficient to provide a pH of at least about 7.5, preferably at least about 8, and when the composition is combined with water forms the emulsion.

In another aspect, the present invention provides an improved synthetic metal working fluid composition comprising an emulsion system comprising: at least one water immiscible component, at least one water dispersible ETA emulsifier, an optional co-emulsifier and an optional coupling agent.

In another aspect, the present invention relates to a process for working metal using a synthetic metal working fluid comprising an emulsion system comprising: at least one water immiscible component, at least one water dispersible ETA, an optional co-emulsifier, an optional coupling agent and water In another aspect, the present invention provides an improved synthetic (water based) hydraulic fluid composition comprising an emulsion system which further comprises: at least one water immiscible component, at least one water dispersible ETA emulsifier, an optional co-emulsifier, an optional coupling agent and water.

In another aspect of the invention is a method of transferring pressure from one point to another using a synthetic water based hydraulic fluid comprising an emulsion system which further comprises: at least one water immiscible component, at least one water dispersible ETA emulsifier, an optional co-emulsifier, an optional coupling agent and water.

In another aspect, the invention relates to an emulsion concentrate comprising: at least one water immiscible component, at least one water dispersible ETA, an optional co-emulsifier and an optional coupling agent; wherein the emulsion concentrate is mixed with water to provide the desired concentration of a water based hydraulic fluid or a water based metal working fluid.

Unless otherwise indicated, the term "metal working fluid" as applied to the present invention carries its customary meaning as well as metal forming, and includes, by way of example and not of limitation, fluids used for metal removal and for lubrication of metal cutting and forming tools in machining and working operations of (but not exclusively) metals. Such operations include turning, milling, drilling, grinding, punching, tapping, threading, rolling, pressing, stamping, drawing and the like. The inventive water based metal working fluids provide cooling as well as lubrication for the tooling, removal of cut chips or fragments away from the tool/workpiece interface and an acceptable post-machining finished surface. Metal working fluids also reduce the cutting forces exerted on a tool and a workpiece thereby significantly extending the life of the cutting tool.

Unless otherwise indicated, the term "working" as used herein and as it relates to operations on a metal workpiece, carries its customary meaning as well as metal forming, and includes, by way of example and not limitation, operations such as rolling, reaming, tapping, drilling, turning, grinding and the like.

Unless otherwise indicated, the term "metal" as used herein, carries its customary meaning and includes aluminum, steel, magnesium and other alloys. Further, the term "metal" as used herein, also includes composites and other such materials that are subject to working operations as defined herein.

Unless otherwise indicated, the term "hydraulic fluids" as applied to the present invention are water dilutable hydraulic fluids and mixtures of water based hydraulic fluids designed to transfer pressure from one point to another.

As applied to this invention, "water based emulsion" and "synthetic system" mean an aqueous microemulsion comprising water which is substantially free of base oil and may include additives such as lubricating agents, anti-wear additives and corrosion inhibitors.

Unless otherwise indicated, the terms "dimer acid" and "trimer acid" as used herein carry their customary meaning and include polymerized products of unsaturated $C_{16}$ to $C_{20}$ fatty acids. Exemplary fatty acids are those derived from soybean oil, tall oil, corn oil, linseed oil, cottonseed oil, castor oil, kapok seed oil, rice bran oil, rapeseed oil, olive oil, sunflower oil, coconut oil, palm kernel oil, beef tallow, tallow and also compounds such as oleic acid, linoleic acid, linolenic acid and tall oil fatty acid. Dimer and trimer acids typically are prepared by condensing these unsaturated carboxylic acids, which are typically mixtures themselves, through their olefinically unsaturated groups, in the presence of catalysts such as acidic clays. The product of the polymerization is a complex mixture of relatively high molecular weight carboxylic acids, predominately 36-carbon dibasic acids and 54-carbon tribasic acids, with no single structure sufficient to characterize each. Component structures may be acyclic, cyclic (monocyclic or bicyclic) or aromatic. The distribution of the various structures depends upon the conditions of their manufacture. It is impractical and rather expensive to fully fractionate polymerized dimer and trimer acids. Accordingly, commercially available dimer acids often contain some trimer acid, and vice versa. Generally, mixtures containing between about 50 to about 90 percent by volume of the trimers are considered as trimer acids. Similarly, those mixtures containing greater than about 50 percent dimers are considered to be dimer acids. The relative amounts of dimer acid and trimer acid present can be determined by gas chromatography, according to methods well known in the art. Dimer and trimer acids are commercially available from a variety of vendors, including Henkel Corporation/Emery Group (e.g., Empol® 1008) and Uniqema (e.g., Pripol® 1004).

As understood in the art, an emulsion is a heterogeneous system comprising a discontinuous phase and a continuous phase and the amount of continuous phase present, such as water, does not significantly alter the relative amounts of ingredients in the discontinuous phase. When describing the present invention in terms of relative amounts of components, the amounts refer to the discontinuous phase regardless of the amount of continuous phase, if any, present. Thus, the relative amounts of ingredients described herein refers to the initial mixture of emulsifiers (emulsion precursor), as well as to any concentrate, pre-form emulsion concentrate, or final working fluid.

Additional features, and advantages of the present invention will become apparent from the detailed description of the invention and the preferred embodiments that follows.

DETAILED DESCRIPTION OF THE INVENTION

The present invention relates to water based emulsions that comprise: (A) a water immiscible component selected from the group consisting of polyhydroxystearic acid, polyhydroxyoleic acid, substantially fully esterified $C_1$ to $C_9$ alkyl ETAs, and mixtures thereof; (B) at least one water dispersible ETA; (C) an optional co-emulsifier which is a $C_8$ to $C_{20}$ organic acid; and (D) an optional alkoxylate coupling agent; wherein, to the extent that components (B) or (C) are not in a salt form, a neutralizing agent is present in an amount sufficient to provide a pH of at least about 7.5, preferably about 8, and when the composition is combined with water it forms the emulsion.

Water immiscible components of the present invention are selected from the group consisting of polyhydroxystearic acid, a polyhydroxyoleic acid, substantially fully esterified $C_1$ to $C_9$ alkyl esters of a trimer acid (water immiscible ETA), and mixtures thereof. Preferably, a $C_1$ to $C_9$ alkyl ester of a trimer acid, more preferably methyl trimerate, 2-ethylhexyl trimerate, ethyl trimerate, isopropyl trimerate, butyl trimerate and octyl trimerate and most preferably 2-ethylhexyl trimerate (e.g., Priolube® 3953, available from Uniqema, Del.). The water immiscible ETAs are biostable without the need for added biocides.

Water dispersible ETAs of the present invention are the esterification product of:

(1) an acid component comprising at least one member of the group consisting of trimer acid (e.g., Pripol® 1040, available from Uniqema, Del.), hydrogenated trimer acid, and mixtures thereof, preferably a trimer acid; and (2) an alcohol component comprising:

(i) at least one straight chain or branched saturated monohydric alcohol having from about 1 to about 24 carbon atoms, preferably from 3 to 14 carbon atoms; and (ii) at least one alkoxy poly(alkylene)glycol having one terminal hydroxy group etherified with a $C_1$-$C_4$ aliphatic monohydric alcohol and which is alkoxylated with from 2 to 25 moles, preferably from 6 to 12 moles, of a $C_2$ to $C_5$ alkylene oxide, more preferably a $C_2$ to $C_3$ alkylene oxide, and most preferably ethylene oxide;

wherein the esterification product retains sufficient carboxylic acid residues that when neutralized, the esterification product is water dispersible In preparing the water dispersible ETAs, the acid and the alcohol component are reacted in any manner known to those skilled in the art such that an ester is formed. The individual alcohol components may be mixed and allowed to react with the acid component, or the esterification may be conducted in successive steps where an initial alcohol component is allowed to react with the acid component and then a successive alcohol components may be added and the esterification reaction continued.

The ETA esters and any organic acid co-emulsifier are neutralized into stoichiometrically neutral salts. The neutralization step must be performed prior to the addition of water. Any neutralizing agent will work but is preferably selected from the group consisting of: ammonium hydroxide; the alkali metal hydroxides; alkyl amines, such as alkyl primary amines typically having 6 to 8 carbons in the alkyl group of the amine; alkanolamines, such as mono-, di-, and tri-alkanolamines; and mixtures thereof. Although any appropriate amine or alkyl hydroxide may be used in accordance with the invention, low molecular weight amines may adversely impact the foaming characteristics of the emulsion unless special considerations are made with the other coemulsifiers. Alkanolamines, especially triethanolamine, are particularly preferred.

If necessary, at least one additional neutralization agent may be added in sufficient quantities to render the resulting emulsion slightly alkaline when the precursor (i.e., the premix of materials which will eventually be emulsified) is dispersed in equal volumes of water. The pH of the resulting mixture should be at least about 7.5 and preferably greater than about 8. Failure to add sufficient base to the emulsion precursor (i.e., before dispersing in water) may result in a poor quality or unstable emulsion and adjusting the pH after a poor quality emulsion has formed may not recover the intrinsic quality of an emulsion.

Within the group of the water immiscible components, individual ETAs and polyhydroxy acids will exhibit different degrees of lipophilicity. Within the group of water dispersible ETAs, individual ETAs will exhibit different degrees of hydrophilicity. Thus, the ratio of component (A) to component (B) and the desirability of a co-emulsifier will vary but can be determined readily by one skilled in the art. The higher the concentration of (A), while retaining quality emulsions, the greater the lubricity and the emulsion stability and the less foaming observed in synthetic (water based) emulsions.

Consequently, when possible, it is preferred that the water immiscible component (A) be present in an amount which is about equal to or greater than the combined total amount of component (B) and co-emulsifier (C). The emulsifier or the emulsifier and co-emulsifier need to be present in an amount to effect the dispersion of component (A) into the synthetic system. Ideally, that amount is what is sufficient, thereby reducing possible foaming. For example, the greater the hydrophilicity of component (B), the less that is needed to obtain the emulsion and the less need, if any, for the co-emulsifier (C). When the hydrophilicity of (B) acts like it has a hydrophile-lipophile balance (HLB) between about 9 and about 12, a co-emulsifier is most likely needed as would be apparent to one in the art. An example of when a co-emulsifier is desired is the combination of the water immiscible component (A) of Priolube® 3953 and the water dispersible component (B) of Priolube® 3952.

Generally, the amount of water immiscible component (A) will be between about 10 and about 75 weight percent of the total weight of (A), (B) and (C). Preferably the amount of water immiscible component is between about 20 and about 60 weight percent, and more preferably between about 45 and about 55 percent. The amount of water dispersible ETAs (B) in the discontinuous (emulsified) phase is typically between about 10 and about 75 weight percent of the total weight of (A), (B) and (C). Preferably the amount of water dispersible ETA is between about 20 and about 60 percent, more preferably between about 45 and about 55 percent. Co-emulsifiers of the present invention are selected from the straight chain or branched organic acids having between 8 and 20 carbon atoms, preferably between 14 and 18 carbon atoms, more preferably about 18 carbon atoms, and mixtures thereof. The amount of co-emulsifier (C) in the discontinuous (emulsified) phase is less than about 50 weight percent of the total weight of components (A), (B) and (C). When the co-emulsifier is needed, it will generally be present in an amount of at least about 10 weight percent of the weight of components (A), (B) and (C). Preferably, the co-emulsifier (C) will be present at less than about 35 weight percent, and most preferably less than about 15 weight percent of the total weight of components (A), (B) and (C). As one skilled in the art would appreciate, unnecessary amounts of co-emulsifiers should be avoided when certain corrosion inhibitor packages (containing low molecular weight amines such as monoethanolamines) are also used because of the likelihood of undesirable foaming. When foaming is not a concern, additional amounts of co-emulsifier can add to the clarity and stability of the water-based emulsion. Therefore, if a co-emulsifier is used, generally an alkoxylate coupling agent is not used as its added advantage is small if present.

The weight ratio of water immiscible component (A) to the combined weight of water dispersible ETAs (B) plus co-emulsifier (C), if present, is between about 3:1 and about 1:7, preferably between about 3:1 and about 1:3, more preferably between about 3:1 and about 2:3.

Optionally, the compositions may further comprise an alkoxylate coupling agent to add additional stability and clarity to the emulsion, for example changing the emulsion from translucent to transparent or extending its shelf life under varied temperature conditions. Useful alkoxylate coupling agents include glycols, polyglycols, polyalkylene glycols, and alkyl alkoxylates obtained from $C_4$ to $C_{15}$ alcohols. Examples of alkoxylate coupling agents include propylene glycol, polypropylene glycol, polyethylene glycol, polyoxypropylene glycol, carbitol, butyl carbitol, hexylene glycol, butanol initiated polypropylene glycol, and isopropyl alcohol. The glycol alkoxylates and the alkyl alkoxylates are preferred, and the alkyl alkoxylates are more preferred. The choice of alkoxylate coupling agent depends on the other components in the emulsion system and those skilled in the art will be able to identify emulsions systems that require a particular alkoxylate coupling agent.

The amount of the alkoxylate coupling agent, therefore, is from 0 to about 25 weight percent of the of the total weight of components (A), (B), (C) and (D), preferably present between about 5 and about 20 weight percent, more preferably present between about 10 and about 15 weight percent.

When an alkoxylate coupling agent is used, it can be added at any time prior to the addition of water.

Optionally, the composition may also comprise additives that typically are employed in metal working and/or hydraulic fluids. These include, by way of example and not of limitation, antioxidants, antiwear additives, extreme pressure additives, biocides, fungicides, metal passivators, corrosion inhibitors, coloring agents and mixtures thereof.

The emulsion is prepared by pre-mixing, and pre-neutralizing if necessary, the water dispersible and water immiscible emulsifiers, co-emulsifiers, and coupling agent(s) and then dispersing the resulting mixture with the other components in water, in any manner known to those skilled in the art. The resulting emulsion mixture contains about 0.25 to about 35 weight percent of the emulsified (discontinuous) phase, preferably about 10 to about 35 weight percent in the case of a pre-form emulsion concentrate and about 0.25 to about 5 weight percent in the final working fluid. It may be necessary to dilute the concentrate in steps, through so-called emulsion pre-form emulsion concentrates (comprising about 10 to about 35 weight percent of the emulsion precursor), before diluting to the desired concentration in the final working fluid.

The following examples are intended to be illustrative of the present invention. Other objects and advantages of the present invention will become apparent to those skilled in the art from the detailed description. As will be realized, the present invention is capable of other and different embodiments, and its several details are capable of modifications in various apparent respects, without departing from the scope and spirit of the present invention. Accordingly, the description is to be regarded as illustrative in nature and not as restrictive.

EXAMPLES

In the examples, material amounts are reported by weight unless indicated otherwise. Ratios between ingredients and percentages are based on weight.

Emkarox® VG 58 is a butanol initiated polypropylene glycol. Hypermer® KD-5 is the source of the polyhydroxystearic acid. Prifac® 7982 is monomer fatty acid obtained as a by-product of dimerization of oleic acid. Priolene® 6910 is a source of oleic acid. Priolube® 3952 and 3955 products are methyl end-capped polyethylene glycol (molecular weight of 350)-2-ethylhexyl trimerate. The Priolube® 3952 product has an acid value range of 28-34 and the Priolube® 3955 product has an acid value range of 45-55. Priolube® 3953 is described as a 2-ethylhexy ester of trimer acid with an acid value range of 15-20. All of the above compounds are available from Uniqema, Del.

Mixed emulsifier compositions were prepared by mixing the individual components and stoichiometrically neutralizing the mixture with the indicated amount of triethanolamine (TEA) to ensure a pH between 7.5 and 8.5. The mixtures were then dispersed in water (3% emulsified phase initially) with vigorous stirring.

For examples 4, 5 and 6, foam tests were conducted using a Waring blender that was modified to include a 1000 milliliter (mL) graduated cylinder mounted on top. Unless indicated otherwise, the test emulsion composition (400 mL) was stirred at high speed for 30 seconds, and total foam volume recorded at 0, 30, 60, 120, and 180 seconds. Results are reported as foam volume as a function of time. For examples 1-3 and 8, the foam tests were visual observations after stirring together the components to obtain the water-based emulsion.

Microtap tests, in Examples 1 to 3, 7 and 8 were conducted using a Microtap II thread tapping machine (manufactured by Microtap USA, Inc. and readily available in the industry), which cuts threads in pre-drilled holes at a selected set of operating parameters. Tests were performed on 2 in.×12 in.× 0.5 in. metal bars containing 6 mm diameter holes, which were supplied by Microtap USA, Inc. and certified as to the alloy composition. The bottom portion of the bars were sealed with cellophane tape, the tape being scored to isolate each hole, and the pre-drilled holes were filled with either the test fluid or the reference fluid. The holes were then threaded ("tapped") and the amount of torque recorded. Three to six tests were performed on holes containing the reference fluid followed by six to eight holes containing the test fluid. The reference fluid was used sequentially across the test bar and the tapping torque measurements were recorded and standardized to the control measurements to correct for any variations in alloy composition or tap wear. Results using the reference fluid were normalized to 100, and results from the test fluid were expressed as a percentage versus the control. Numbers less than 100 show reduced torque (i.e., improved lubricity) whereas values greater than 100 represent increased torque (i.e., less effective lubricity) relative to the reference fluid. Unless otherwise specified, 6061 Aluminum was used for testing. In examples 1-3, 7 and 8 the reference fluid was a 2.5% aqueous solution of Synperonic® 25R2 (an ethylene oxide/propylene oxide block co-polymer, available from Uniqema, Del.), a well-known and excellent lubricant fluid system. In examples 1 and 9 a second reference fluid was a 1% aqueous solution of Priolube® 3955 (85 wt %) with triethanolamine (15 wt %). In example 6 the reference fluid was a 0.5% aqueous solution of the Priolube® 3955 with triethanolamine. The test fluid, according to the invention, was a 1% aqueous solution of emulsified phase. Where so indicated, hard water contained standard concentrations of calcium and magnesium salts, as defined by the Collaborative International Pesticides Analytical Council (CIPAC).

Example 1

An emulsion precursor slurry was prepared by stirring together approximately 51 grams Priolube® 3953 (water immiscible), 26 grams of Priolube® 3955 (water dispersible), 13 grams of co-emulsifier (Prifac® 7982) and 6 grams of triethanolamine (which when diluted 20:1 with water produced an aqueous phase with pH approximately 8). On vigorous stirring, the concentrate was emulsified into a 1% emulsion in water, yielding a clear, near transparent emulsion. This emulsion produced extremely low levels of foam, which collapsed almost immediately. Microtap testing of a 1% (percent) solution showed torque values that were 60% of the 2.5% (percent) Synperonic® 25R2 reference fluid. Microtap testing of the 1% Priolube® 3955 aqueous reference solution using 6061 aluminum and 1018 steel respectively showed torque values that were 111% and 109% respectively of the 1% solution according to the invention.

Example 2

An emulsion precursor slurry was prepared by stirring together approximately 14 grams of Priolube® 3953 (water immiscible), 7 grams of Priolube® 3955 (water dispersible), 2.5 grams of oleic acid, and 4.5 grams of triethanolamine. On vigorous stirring, this concentrate emulsified in water to produce a clear 1% microemulsion with extremely low levels of foam that collapsed almost immediately. Microtap testing of a 1% (percent) solution showed torque values that were 62% of the 2.5% (percent) Synperonic® 25R2 reference fluid.

Example 3

An emulsion precursor slurry was prepared by stirring together approximately 7 grams of Priolube® 3953 (water immiscible), 14 grams of Priolube® 3955 (water dispersible), 2.5 grams of oleic acid, and 6 grams of triethanolamine. On vigorous stirring, this concentrate emulsified in water to produce a clear 1% microemulsion which exhibited extremely low levels of foam that collapsed almost immediately. Microtap testing of a 1% (percent) solution showed torque values that were 73% of the 2.5% (percent) Synperonic® 25R2 reference fluid.

Examples 1 to 3 illustrate the enhanced lubricity properties of the samples of the present invention as compared to the two reference fluids.

Example 4

Two separate emulsion concentrates were prepared by stirring together their corresponding individual components: Concentrate A is approximately 14 grams of Priolube® 3953 (water immiscible), 7 grams of Priolube® 3955 (water dispersible), 2.5 grams of Prifac® 7982 (co-emulsifier), and 4.5 grams of triethanolamine to form a concentrate slurry; Concentrate B is approximately 7 grams of Priolube® 3953 (water immiscible), 14 grams of Priolube® 3955 (water dispersible), 2.5 grams of Prifac® 7982, and 6 grams of triethanolamine to form a concentrate slurry. Concentrate A and B were emulsified as 0.5 weight percent in water, and a foam test was conducted with and without commercially available corrosion inhibitor packages. When present, the corrosion inhibitor package consisted of 0.5 weight percent of Aqualox 232 (an alkanolamine salt of carboxylic acid based inhibitor package from Lubrizol Corporation of Wickliffe, Ohio), and Monacor™ BE (a monoethanolamine and monoisopropanolamine borate ester-based inhibitor package from Uniqema, Del.). Each test mixture contained the indicated amount of components, and was emulsified with sufficient water (deionized or hardened, as indicated) to produce 400 mL of final emulsion. The mixtures were stirred at high power in the Waring blender for 30 seconds before allowing the foam to settle. Foam volumes are reported in Table 1 (total volumes less the 400 mL liquid volumes).

TABLE 1

| | Concentrate (g) | | | Water hardness | Foam Volume (mL) at: | | | | |
|---|---|---|---|---|---|---|---|---|---|
| Entry | A | B | Corrosion Inhibitor | (ppm) | 0 sec. | 30 sec. | 60 sec. | 120 sec. | 180 sec. |
| 1 | 2 | 0 | No | 0 | 100 | 60 | 0 | | |
| 2 | 2 | 0 | No | 100 | 20 | 0 | | | |
| 3 | 0 | 2 | No | 0 | 130 | 90 | 60 | 0 | |
| 4 | 0 | 2 | No | 100 | 40 | 0 | | | |
| 5 | 0 | 0 | Yes | 0 | 350 | 270 | 190 | 110 | 40 |
| 6 | 2 | 0 | Yes | 0 | 180 | 170 | 170 | 170 | 170 |
| 7 | 0 | 2 | Yes | 0 | 230 | 230 | 220 | 220 | 220 |

TABLE 1-continued

| Entry | Concentrate (g) A | Concentrate (g) B | Corrosion Inhibitor | Water hardness (ppm) | Foam Volume (mL) at: 0 sec. | 30 sec. | 60 sec. | 120 sec. | 180 sec. |
|---|---|---|---|---|---|---|---|---|---|
| 8 | 0 | 0 | Yes | 100 | 200 | 70 | 30 | 10 | |
| 9 | 2 | 0 | Yes | 100 | 100 | 20 | 0 | | |
| 10 | 0 | 2 | Yes | 100 | 130 | 80 | 10 | 0 | |

The results in Table 1 demonstrate that water based emulsions of the present invention, with hard or deionized water, initially formed small amounts of unstable foams, which dissipated quickly. However, certain commercial corrosion inhibitor packages can cause an increase in the amount of foam and the time required for it to dissipate.

Example 5

A water based emulsion concentrate slurry, Concentrate C, was prepared by stirring together approximately 10 grams of Priolube® 3953 (water immiscible), 10 grams of Priolube® 3955 (water dispersible), 3 grams of Emkarox® VG58 (alkoxylated coupling agent), and 4 grams of triethanolamine. The concentration was emulsified with water to form a 0.5% emulsion and the experimental conditions used were the same as described as in Example 4. The results are reported in Table 2.

TABLE 2

| Entry | Concentrate C (grams) | Corrosion Inhibitor | Water hardness (ppm) | Foam Volume (mL) at: 0 sec. | 30 sec. | 60 sec. | 120 sec. | 180 sec. |
|---|---|---|---|---|---|---|---|---|
| 1 | 2 | No | 0 | 120 | 40 | 20 | 20 | 10 |
| 2 | 0 | Yes | 0 | 350 | 270 | 190 | 110 | 40 |
| 3 | 2 | Yes | 0 | 110 | 60 | 50 | 40 | 30 |

The results in Table 2 demonstrate that a water based emulsion of the present invention, with deionized water, initially formed small amounts of unstable foam, which quickly reduced in volume irrespective of the presence of corrosion inhibitor.

Example 6

Water based emulsions A, B and C were prepared as in examples 4 and 5. A 0.5% aqueous emulsion of Priolube® 3955 was prepared as a reference standard. All were prepared with deionized water and no corrosion inhibitor was present. The foam volume was measured as described in example 4 and the results are reported in Table 3.

TABLE 3

| Entry | Concentrate | Foam Vol (mL) at 0 secs. | 30. secs. | 60 secs. | 120 secs. | 180 secs. |
|---|---|---|---|---|---|---|
| 1 | A | 100 | 60 | 0 | | |
| 2 | B | 130 | 90 | 60 | 0 | |
| 3 | C | 120 | 40 | 20 | 20 | 10 |

TABLE 3-continued

| Entry | Concentrate | Foam Vol (mL) at 0 secs. | 30. secs. | 60 secs. | 120 secs. | 180 secs. |
|---|---|---|---|---|---|---|
| 4 | Priolube ® 3955 reference | 120 | 60 | 50 | 50 | 40 |

The results in Table 3 demonstrates that water based emulsions of the present invention form small amounts of low foam which dissipate quicker than the initial low foam of the reference fluid.

Example 7

Table 4 below shows the dramatic improvement in lubricity in the samples of the present invention (at 0.5% concentration) as compared to the 2.5% Synperonic® 25R2 reference fluid. The Synperonic® 25R2 reference fluid is deemed to have a tapping torque of 100% with respect to the concentrations according to the invention in Table 4. When present, both test and reference Microtest samples contained equivalent levels of corrosion inhibitors.

TABLE 4

| Entry | Concentrate (g) A | Concentrate (g) B | Concentrate (g) C | Corrosion Inhibitor | Water Hardness (ppm) | Relative Tapping Torque (%) |
|---|---|---|---|---|---|---|
| 1 | 2 | 0 | 0 | No | 100 | 72 |
| 2 | 0 | 2 | 0 | No | 100 | 84 |
| 3 | 2 | 0 | 0 | Yes | 100 | 80 |
| 4 | 0 | 2 | 0 | Yes | 100 | 77 |
| 5 | 0 | 0 | 2 | No | 0 | 81 |
| 6 | 0 | 0 | 2 | Yes | 0 | 83 |

Example 8

An emulsion concentrate slurry was prepared by stirring together approximately 17 grams of Hypermer® KD-5 (water immiscible), 4 grams of Priolube® 3955 (water dispersible), 3 grams of oleic acid (co-emulsifier), and 3 grams of triethanolamine. On vigorous stirring, this concentrate emulsified in water to produce a clear 1% microemulsion which exhibited extremely low levels of foam that collapsed almost immediately. Microtap testing of a 1% (percent) solution showed torque values that were 65% of the 2.5% (percent) Synperonic® 25R2 reference fluid.

Example 9

A emulsion concentrate slurry of a 1:1 mixture of Priolube® 3953 and Priolube® 3955 with 11% triethanolamine, a sample according to the invention, was emulsified in water of hardness 20 ppm and 300 pmm respectively to produce two 3% emulsions. Both emulsions were transparent.

However a reference emulsion concentrate slurry of Priolube® 3955 (85%) with triethanolamine (15%), when emulsified in both hard and soft water to a 3% emulsion formed an opaque dispersion.

What is claimed is:

1. A composition comprising:

(A) at least one water immiscible component selected from the group consisting of polyhydroxystearic acid, a polyhydroxyoleic acid, substantially fully esterified $C_1$ to $C_9$ alkyl esters of trimer acid, and mixtures thereof;

(B) at least one water dispersible esterified trimer acid, wherein the water dispersible esterified trimer acid is the esterification product of:

(1) an acid component comprising at least one member of the group consisting of trimer acid, hydrogenated trimer acid, and mixtures thereof; and (2) an alcohol component comprising:

(i) at least one straight chain or branched saturated monohydric alcohol having from about 1 to about 24 carbon atoms; and (ii) at least one alkoxy poly(alkylene)glycol having one terminal hydroxyl group etherified with a $C_1$ to $C_4$ aliphatic monohydric alcohol and which is alkoxylated with from 2 to 25 moles of a $C_2$ to $C_5$ alkylene oxide; and (C) a co-emulsifier selected from the group consisting of straight chain or branched organic acids having between 8 and 20 carbon atoms and mixtures thereof, wherein the total amount of co-emulsifier is from 0 to about 50 weight percent of the total amount of (A), (B) and (C);

wherein the weight ratio of the total of (A) to the combined total amount of (B) plus (C) is between about 3:1 and about 1:7 and the composition is capable of forming a synthetic system having a pH of greater than about 7.5 when added to water.

2. The composition of claim 1 wherein the weight ratio of the total amount of (A) to the combined total amount of (B) plus (C) is between about 3:1 and about 1:3.

3. The composition of claim 2 wherein the weight ratio of the total amount of (A) to the combined total amount of (B) plus (C) is about 3:1 to 2:3.

4. The composition of claim 1 wherein the total amount of (A) is greater than or equal to the total weight amount of (B) and (C).

5. The composition of claim 2 wherein the total amount of (A) is between about 45 and about 55 weight percent.

6. The composition of claim 2 wherein (A) is selected from the group consisting of methyl trimerate, 2-ethylhexyl trimerate, ethyl trimerate, isopropyl trimerate, butyl trimerate and octyl trimerate.

7. The composition of claim 3 wherein (A) is 2-ethylhexyl trimerate.

8. The composition of claim 2 wherein (i) the acid component of (B) is trimer acid; (ii) the at least one straight chain or branched saturated monohydric alcohol of (B) has 3 to 14 carbon atoms; and (iii) the at least one alkoxy poly(alkylene) glycol of (B) is alkoxylated with from 6 to 12 moles of a $_{02}$ to $C_3$ alkylene oxide.

9. The composition of claim 2 wherein when (C) is present, it is present in a weight amount of at least about 10 weight percent and less than about 35 weight percent of the weight amount of (A), (B) and (C).

10. The composition of claim 9 wherein (C) is an organic acid having between 14 and 18 carbon atoms.

11. The composition of claim 1 wherein: (i) at least one water immiscible component of (A) is selected from the group consisting of methyl trimerate, 2-ethylhexyl trimerate, ethyl trimerate, isopropyl trimerate, butyl trimerate and octyl trimerate; (ii) the acid component of (B) is trimer acid; (iii) the at least one straight chain or branched saturated monohydric alcohol of (B) has 3 to 14 carbon atoms; (iv) the at least one alkoxy poly(alkylene)glycol of (B) is alkoxylated with from 6 to 12 moles of a $C_2$ alkylene oxide; and (v) when the co-emulsifier is present, it is present in a weight amount of at least about 10 weight percent and less than about 35 weight percent of the weight amount of (A), (B) and (C).

12. The composition of claim 11 wherein the weight ratio of the total amount of (A) to the combined total amount of (B) plus (C) is between about 3:1 and about 1:3, and when the co-emulsifier is present, it is an organic acid having between 14 and 18 carbon atoms.

13. The composition of claim 12 wherein: (i) the total amount of (A) is greater than or about equal to the combined total amount of (B) and (C).

14. The composition of claim 2 wherein (C) is present at 0 weight percent and the synthetic system further comprises (D) an alkoxylate coupling agent selected from the group consisting of glycols, polyglycols, polyalkylene glycols, alkyl alkoxylates obtained from $C_4$ to $C_{15}$ alcohols, and mixtures thereof, wherein the total amount of alkoxylate coupling agent is from 5 to about 20 weight percent of the total amount of (A), (B) and (D).

15. The composition of claim 14 wherein the alkoxylated coupling agent (D) is selected from the group consisting of alkyl alkoxylates and is present from about 10 to about 15 weight percent of the total amount of (A), (B) and (D).

16. A composition comprising:

(A) at least one water immiscible component selected from the group consisting of substantially fully esterified $C_1$ to $C_9$ alkyl esters of trimer acid, and mixtures thereof;

(B) at least one water dispersible esterified trimer acid that is the esterification product of:

(1) an acid component comprising at least one member of the group consisting of trimer acid, hydrogenated trimer acid, and mixtures thereof; and (2) an alcohol component comprising:

(i) at least one straight chain or branched saturated monohydric alcohol having from about 1 to about 24 carbon atoms; and (ii) at least one alkoxy poly(alkylene)glycol having one terminal hydroxyl group etherified with a $C_1$ to $C_4$ aliphatic monohydric alcohol and which is alkoxylated with from 2 to 25 moles of $C_2$ to $C_3$ alkylene oxide;

(C) optionally at least one co-emulsifier selected from the group consisting of straight chain or branched organic acids having between 8 and 20 carbon atoms, and mixtures thereof, wherein the total amount of co-emulsifier, when present, is less than about 50 weight percent of the total weight of (A), (B) and (C); and (D) at least one alkoxylate coupling agent selected from the group consisting of glycols, polyglycols, polyalkylene glycols, alkyl alkoxylates obtained from $C_4$ to $C_{15}$ alcohols, and mixtures thereof, wherein (D) is present from 5 to about 20 weight percent of the weight of (A), (B), (C) and (D);

wherein the weight ratio of the total amount of (A) to the total amount of (B) and (C) is between about 3:1 and about 1:3 and the composition is capable of forming a synthetic system having a pH of greater than about 7.5 when added to water.

17. The composition of claim 16 wherein the total amount (A) is greater than or equal to the combined total amount of (B) and (C) and wherein (C) is present at 0 weight percent.

18. The composition of claim 17 wherein (i) the total number of (A) is about equal to or greater than the combined total amount of (B) plus (C); and (ii) the at least one alkoxylate coupling agent is present from about 10 to about 15 weight percent of the total amount of (A), (B) and (D).

19. The composition of claim 17 wherein: (i) the acid component of (B) is trimer acid; (ii) the at least one straight chain or branched saturated monohydric alcohol of (B) has 3 to 14 carbon atoms; (iii) the at least one alkoxy poly(alkylene) glycol of (B) is alkoxylated with from 6 to 12 moles of a $C_2$ alkylene oxide; (iv) the at least one alkoxylate coupling agent (D) is selected from the group consisting of polyalkylene glycols, and alkyl alkoxylates obtained from $C_4$ to $C_{15}$ alcohols and mixtures thereof.

20. The composition of claim 19 wherein the at least one water immiscible component (A) is selected from the group consisting of methyl trimerate, 2 ethylhexyl trimerate, ethyl trimerate, isopropyl trimerate, butyl trimerate, octyl trimerate and mixtures thereof.

21. The composition of claim 20 wherein the alkoxylate coupling agent (D) is selected from the group consisting of alkyl alkoxylates.

22. The composition of claim 20 wherein the at least one water immiscible component of (A) is 2-ethylhexyl trimerate.

23. A composition capable of forming a water based emulsion when added to water, comprising: (A) a 2-ethylhexyl ester of trimer acid; (B) a methyl end-capped polyethylene glycol-2-ethylhexyl trimerate wherein the molecular weight of the polyethylene glycol is about 350 and mixtures thereof; (D) a butanol initiated polypropylene glycol coupling agent; and triethanolamine wherein the coupling agent (D) is about 10 to about 15 weight percent of the weight of (A), (B) and (D), and the triethanolamine is present in an amount to obtain a pH of at least 8 for the water based emulsion.

24. A method of working metal, comprising contacting the metal with an emulsion, comprising a composition of claim 1.

25. A water based hydraulic liquid, comprising an emulsion formed from the composition of claim 1.

26. An emulsion comprising a composition of claim 1 and water.

27. A composition comprising:

(A) at least one water immiscible component selected from the group consisting of polyhydroxystearic acid, a polyhydroxyoleic acid, substantially fully esterified $C_1$ to $C_9$ alkyl esters of trimer acid, and mixtures thereof:

(B) at least one water dispersible esterified trimer acid, wherein the water dispersible esterified trimer acid is the esterification product of:

(1) an acid component comprising at least one member of the group consisting of trimer acid, hydrogenated trimer acid and mixtures thereof; and (2) an alcohol component comprising:

(i) at least one straight chain or branched saturated monohydric alcohol having from about 1 to about 24 carbon atoms; and (ii) at least one alkoxy poly(alkylene)glycol having one terminal hydroxyl group etherified with a $C_1$ to $C_4$ aliphatic monohydric alcohol and which is alkoxylated with from 2 to 25 moles of a $C_2$ to $C_5$ alkylene oxide; and (C) a co-emulsifier selected from the group consisting of straight chain or branched organic acids having between 8 and 20 carbon atoms and mixtures thereof, wherein the total amount of co-emulsifier is from 0 to about 50 weight percent of the total amount of (A), (B) and (C);

wherein the weight ratio of the total of (A) to the combined amount of (B) plus (C) is between about 3:1 and about 1:7;

said composition further comprising at least about 6 weight percent of a neutralizing agent based on the total amount of (A), (B) and (C);

and wherein said composition is capable of forming a synthetic system having a pH of greater than about 7.5 when added to water.

28. A composition comprising:

(A) at least one water immiscible component selected from the group consisting of substantially fully esterified $C_1$ to $C_9$ alkyl esters of trimer acid, and mixtures thereof:

(B) at least one water dispersible esterified trimer acid that is the esterification product of:

(1) an acid component comprising at least one member of the group consisting of trimer acid, hydrogenated trimer acid and mixtures thereof; and (2) an alcohol component comprising:

(i) at least one straight chain or branched saturated monohydric alcohol having from about 1 to about 24 carbon atoms; and (ii) at least one alkoxy poly(alkylene)glycol having one terminal hydroxyl group etherified with a $C_1$ to $C_4$ aliphatic monohydric alcohol and which is alkoxylated with from 2 to 25 moles of a $C_2$ to $C_3$ alkylene oxide;

(C) optionally at least one co-emulsifier selected from the group consisting of straight chain or branched organic acids having between 8 and 20 carbon atoms, and mixtures thereof, wherein the total amount of co-emulsifier, when present, is less than about 50 weight percent of the total weight of (A), (B) and (C); and (D) at least one alkoxylate coupling agent selected from the group consisting of glycols, polyglycols, polyalkylene glycols, alkyl alkoxylates obtained from $C_4$ to $C_{15}$ alcohols, and mixtures thereof, wherein (D) is present from 5 to about 20 weight percent of the weight of (A), (B), (C) and (D);

wherein the weight ratio of the total of (A) to the combined amount of (B) plus (C) is between about 3:1 and about 1:3;

said composition further comprising at least about 6 weight percent of a neutralizing agent based on the total amount of (A), (B), (C) and (D);

and wherein said composition is capable of forming a synthetic system having a pH of greater than about 8.0 when added to water.

29. A composition according to claim 27 wherein the neutralizing agent is an alkanolamine.

30. A composition according to claim 28 wherein the neutralizing agent is an alkanolamine.

31. A composition capable of forming a water based emulsion when added to water, comprising:

(A) a 2-ethylhexyl ester of trimer acid;

(B) a methyl end-capped polyethylene glycol-2-ethylhexyl trimerate wherein the molecular weight of the polypropylene glycol is about 350 and mixtures thereof;

(D) a butanol initiated polypropylene glycol coupling agent; and (E) triethanolamine;

wherein (D) is about 10-15 wt % of the total amount of (A), (B) and (D); and wherein (E) is at least about 6 wt % of the total amount of (A), (B) and (D).

* * * * *